United States Patent [19]

Maisch et al.

[11] Patent Number: 4,985,002

[45] Date of Patent: Jan. 15, 1991

[54] SHIELDED CIRCULAR PLUG CONNECTOR

[75] Inventors: Gunter Maisch, Bad Neustadt; Alfons Haag, Bastheim, both of Fed. Rep. of Germany; Ken Wood, Lake Zurich, Ill.

[73] Assignee: Preh, Elektrofeinmechanische Werke Jakob Preh, Nachf, GmbH & Co., Bad Neustadt/Saale, Fed. Rep. of Germany

[21] Appl. No.: 261,857

[22] Filed: Oct. 25, 1988

[51] Int. Cl.[5] ..... H01R 13/658

[52] U.S. Cl. ..... 439/607

[58] Field of Search ..... 439/595, 598, 603, 607, 439/608, 609, 610, 903

[56] References Cited

U.S. PATENT DOCUMENTS

| | | | |
|---|---|---|---|
| 2,905,922 | 9/1959 | Tuchel | 439/607 |
| 3,478,305 | 11/1969 | Chirumbolo | 439/744 |
| 3,926,499 | 12/1975 | Bailey et al. | 439/610 |
| 4,361,376 | 11/1982 | Gallusser et al. | 439/598 |
| 4,364,621 | 12/1982 | Janvrin et al. | 439/595 |
| 4,413,875 | 11/1983 | Mattingly | 439/660 |
| 4,493,525 | 5/1985 | Hall et al. | 439/610 |
| 4,634,208 | 1/1987 | Hall | 439/610 |
| 4,659,164 | 4/1987 | Reuss | 439/607 |
| 4,674,807 | 6/1987 | Boteler | 439/607 |
| 4,684,199 | 8/1987 | Ezure et al. | 439/610 |
| 4,685,758 | 8/1987 | Yoshida | 439/607 |

FOREIGN PATENT DOCUMENTS

| | | | |
|---|---|---|---|
| 231008 | 1/1959 | Australia | 439/607 |
| 0118168 | 10/1986 | European Pat. Off. . | |
| 0207322 | 1/1987 | European Pat. Off. . | |
| 3621950 | 1/1988 | Fed. Rep. of Germany . | |

*Primary Examiner*—William Briggs

*Attorney, Agent, or Firm*—Fish & Richardson

[57] ABSTRACT

To simplify the assembly of a shielded circular plug connector (3), it is proposed to provide the shield sleeve (10) of the plug connector (3) with radially raised embossings (12) and the support part containing the pin-type or socket-type plug contacts (2) with spring elements. When joined together, these two parts interlock automatically.

5 Claims, 2 Drawing Sheets

SHIELDED CIRCULAR PLUG CONNECTOR

The invention relates to a shielded circular plug connector for a cable, especially of the multiconductor type, provided with a support part and pin or socket contacts fixed therein and with a tubular shield sleeve which is made from semifinished material and which extends over the length of the plug connector to the cable holder, the support part being immobilized against rotational and linear displacement in the shield sleeve.

European Patent No. A 0,207,322 describes such a shielded circular plug connector. After electrical connection of the conductor ends of the cable with the pin contacts of the support part, the shield sleeve is pushed over the support part. The immobilization of the support part in its operational position inside the shield sleeve is effected by subsequently made indentations. This type of immobilization of the support part is expensive and also necessitates special assembly devices.

In another plug connector of the type mentioned initially, the shield sleeve consists of two half shells (U.S. Pat. No. 4,493,525). When the two half shells are joined together, the support part is immobilized with its integral moldings in matching openings of the half shells. For such a plug connector, no special assembly device is needed to immobilize the support part. However, the openings in the half shells represent an undesired leak in the shielding effect of the shield sleeve.

Another known plug connector is provided with a shield sleeve of cast metal. In this plug connector, the support part is screwed together with the shield sleeve (U.S. Pat. No. 4,659,164). The screw needed for this purpose is an additional part; moreover, shield sleeves made from cast metal are, because of their lack of post-formability, poorly suited for leak-free shielding of the cable entry hole.

West German Patent No. A 3,621,950 discloses an unshielded plug connector, the support part of which is provided with integrally molded spring arms. After connection of the conductor ends of the cable with the contact elements of the support part, the plastic sleeve of the plug connector is pushed over the support part. As soon as the support part arrives in this way in its operational position, it automatically becomes immobilized against rotational or linear displacement, by the fact that its spring arms latch into matching recesses on the inside of the plastic sleeve. Although this plug connector construction is advantageous for plug connector assembly, it cannot be adopted without further modifications for shielded designs. It would be simple to provide the jacket of the shield sleeve (European Patent No. A 0,207,322) with openings, into which the spring arms of the support part then latch; however, undesired leaks are then again formed. A shield sleeve consisting, for example, of die-cast zinc and shaped to match the plastic sleeve suffers from the aforesaid disadvantage and is expensive to make.

The object of the invention is to provide, for the plug connector mentioned initially, an arrangement which simplifies the tool-less immobilization of the support part carrying the plug contacts in the shield sleeve, without perforating the jacket surface of the shield sleeve. The proposed solution is achieved in that the shield sleeve is provided with a stop, against which there abuts the support part, which can be introduced counter to the insertion direction, in that the support part has at least two oppositely located, integrally molded spring elements which exert spring action in the radial direction relative to the shield-sleeve axis, and in that the completely sealed jacket of the shield sleeve contains radially raised embossings lined up with the spring elements, into which embossings the spring elements of the support part abutting against the stop can automatically latch, thereby immobilizing said support part. It is thus possible in advantageous manner, after connection of the conductor ends of the cable with the corresponding ends of the plug contacts, e.g., pin contacts, of the support part, to introduce said support part without the assistance of special assembly devices or of a tool or of an additional part into the shield sleeve, until the spring elements of the support part automatically latch into the radially raised embossings at the intended position. With latching, the support part is immobilized in the shield sleeve both against rotational movement and against linear movement along the shield sleeve axis. Because of the raised shape of the embossing, no space for the spring travel of the spring elements is needed in the interior of the shield sleeve, which emphasizes the advantage of the solution especially for plug connectors with small diameter, since the cross-sectional area of the plug connector remains almost completely available for occupancy with, for example, pin contacts.

If the shield sleeve is made as a deep-drawn part of sheet metal, an aesthetically pleasing, stepwise or continuous taper of the sleeve diameter to the cable holder is obtained in simple manner. The raised embossing also facilitates the alignment or adhesion of a coating of plastic on the shield sleeve. Such a coating is intended to increase the ease of handling of the plug connector, for example by means of grooves made in said coating. A star-shaped crimp in the cable holder provides improved contact between the shield sleeve and the exposed braided shield of the cable. By means of a longitudinal groove running parallel to the shield-sleeve axis in the plug region of the shield sleeve, the contact pairs formed with the plug-connector mating contacts are aligned.

The invention is explained in more detail in the following by means of an example and drawings in which:

FIG. 1 shows a support part with pin contacts with attached cable before the sleeve is pushed on.

Figure 1:
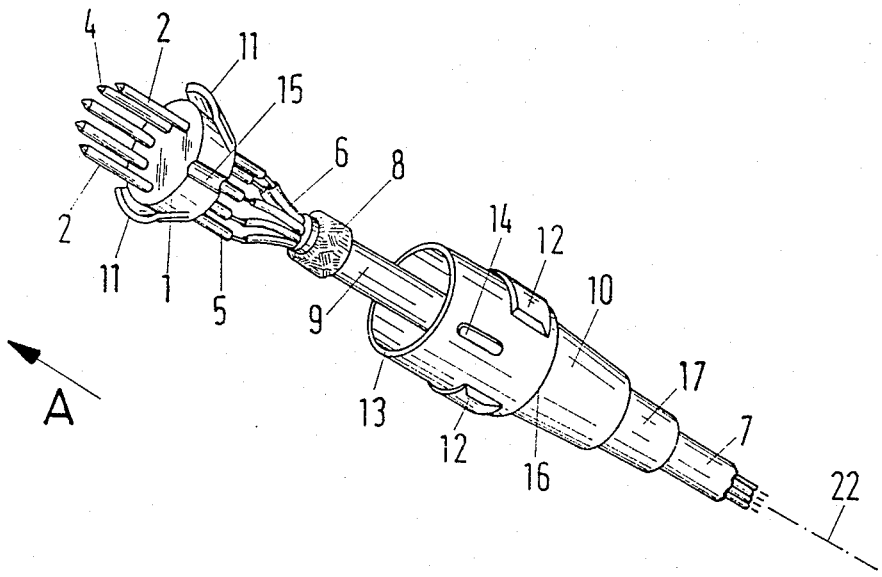

FIG. 1 shows the support part (1) of a plug connector (3) with a plurality of pin contacts (2) fixed therein, which contacts, when the plug connector is used as intended, are inserted with their plug tips (4) into correspondingly disposed socket contacts of, for example, a receptacle (not shown), thus making an electrical connection. The pin contacts (2) penetrate through the support part with their connection ends (5). These connection ends (5) are connected in electrically conducting manner with conductor ends (6) of an electrical cable (7), for example by soldering. The cable is shielded with a braided shield (8), which is exposed at the cable end (9) and is turned back over the external cable insulation. A shield sleeve (10) is pushed over the cable and held loosely. The pin contacts (2) of surface-refine brass are sealed into the support part (1) consisting, for example, of polyamide which is resistant to soldering temperature. The shield sleeve (10) is fabricated from deep-drawn steel (e.g., ST4); its surface is copper-plated and then nickel-plated.

The support part is provided with two diametrically opposite, integrally molded spring elements (11), which hook outward in the insertion direction (A) to exert a radial spring action. In the jacket (13) of the shield sleeve, radially raised embossings (12) lined up with the two spring elements (11) of the support part have been made by means of a suitable embossing device. When the support part (1) is appropriately positioned, the spring elements (11) can, by hooking outward, penetrate into the embossed pockets (24) of the embossing (12) (see FIG. 5) and can, by being braced against surfaces (23), become immobilized in the insertion direction (A).

Counter to the insertion direction (A), the support part (1) is braced directly against the stop (16). The stop is formed by a stepwise taper of the diameter of the jacket (13), which taper is easy to produce in deep-drawing technology.

In the example, the spring elements become immobilized in the insertion direction (A). With appropriate shape of the support part (1) and of the embossings (12), immobilization of the support part in the shield sleeve (10) counter to the insertion direction (A) can also be provided in comparable manner. Even a combined arrangement is conceivable, especially for cylindrical shield sleeves. In this case, appropriately disposed spring elements (11) of the support part (1) would effect immobilization thereof both in the insertion direction and counter to said direction.

Together with the slot (15) of the support part, the groove (14) running parallel to the shield-sleeve axis (22) in the jacket (13) ensures the correct rotational position during assembly of the shield sleeve. The groove (14) projects beyond the assembled support part in the insertion direction (A) and thus provides orientation in forming a plug connection.

Figure 2:
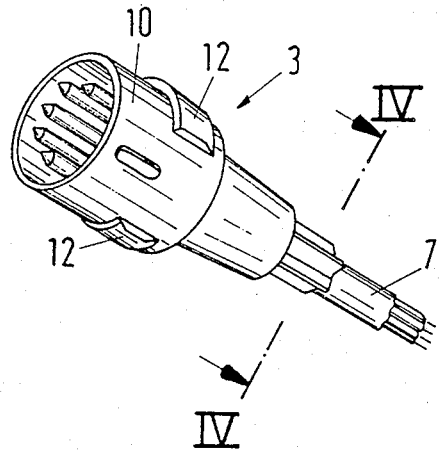
FIG. 2 shows the same, finished.
Figure 4:
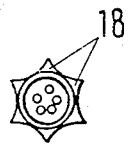
FIG. 4 shows a cross-sectional diagram of the cable holder of FIG. 2.

FIG. 2 shows a plug connector (3) in finally assembled form. In this case the shield sleeve has been pushed over the support part until the support part abuts against the stop (16). In this position, the spring elements are automatically latched into the embossed pockets (24) and they immobilize the support part. If in this situation the spring elements are also laterally guided in the embossed pockets, the immobilization is also rotationally stable, independently of the groove (14). When the shield sleeve is pushed on, the braided shield (8) is brought into the region of the cable holder (17). The star-shaped crimp thereof (18, FIG. 4) provides a plurality of peripheral contacts of the braided shield and thus good shielding with respect to RF signals a the cable entry hole of the shield sleeve. Since the jacket (13) of the shield sleeve is free of penetrations, an excellent RF shielding on the whole is therefore obtained for the plug connector, the assembly of which, at the location of use, for example, is simplified by the innovation.

Figure 3:
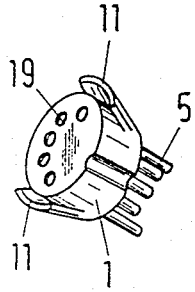
FIG. 3 shows a support part with socket contacts.
Figure 5:
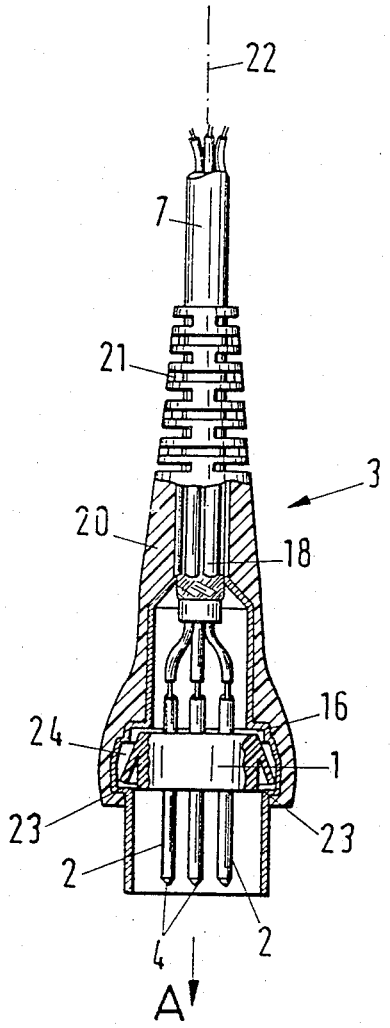
FIG. 5 shows a shielded plug connector in longitudinal section.

A support part with socket contacts (19) is illustrated in FIG. 3. In FIG. 5, the shield sleeve (10) is partly covered with a handling sleeve (20) of, for example, polyethylene, which handling sleeve in turn is additionally held at the radially raised embossings (12). The handling sleeve is extended counter to the insertion direction (A) over and beyond the cable holder (17), thus serving as protection against kinking (21).

The complete assembly of the plug connector is achieved approximately in the following steps: firstly the prefabricated shield sleeve is pushed over the cable end, and then the conductor ends are exposed and some insulation is stripped from them for the soldered connection. Thereafter the conductor ends are soldered to the pin or socket contacts of the support part, which has also been prefabricated. After the shielding of the cable has been turned back over the external insulation of the cable, the shield sleeve is pushed in the insertion direction over the support part, which automatically interlocks with the shield sleeve, so that a special fastening of the support part is not needed. The assembly of the shielded circular plug connector is completed with the star-shaped crimping of the cable holder. If needed, the plug connector can additionally be coated with a handling sleeve of plastic, for example by extrusion molding.

We claim:

1. A shielded circular plug connector for a cable provided with a support part and pin or socket contacts fixed there and a jacket completely sealing the plug connector from electro-magnetic radiation which includes a conductive tubular shield sleeve having a central axis therethrough and having no lateral openings through the sleeve, and which is made of semifinished material and which extends over the length of the plug connector to a cable holder thereon, the support part being immobilized against rotational and linear displacement in the shield sleeve, wherein the shield sleeve is provided with a stop against which abuts the support part which is introduced in a direction counter to the insertion direction, the support part having at least two oppositely located, integrally molded spring elements which exert spring action in a direction relative to the shield sleeve axis, the shield sleeve contains radially raised embossings lines up with the spring elements into which embossings the spring elements of the support part abutting against the stop can automatically latch, thereby immobilizing said support part.

2. A shielded circular plug connector according to claim 1, wherein the shield sleeve is a deep-drawn part.

3. A shielded circular plug connector according to claim 1 or 2, wherein a handling sleeve of plastic at least partially covers the shield sleeve.

4. A shielded circular plug connector according to one of claims 1 or 2, wherein the cable holder is crimped in star-shaped manner (18).

5. A shielded circular plug connector according to one of claims 1 or 2, wherein the shield sleeve is provided with a groove running parallel to the shield-sleeve axis.

* * * * *